US005647787A

United States Patent [19]

Raviv et al.

[11] Patent Number: 5,647,787

[45] Date of Patent: Jul. 15, 1997

[54] SOUND CONTROLLED TOY

[76] Inventors: Roni Raviv, 7 Maccabi Street, Ness Ziona, Israel, 70400; Omri Rothschild, 4 Abraham Lev Street, Tel Aviv, Israel, 64284

[21] Appl. No.: 135,439

[22] Filed: Oct. 13, 1993

[51] Int. Cl.[6] ..... A63H 30/00; A63H 33/02

[52] U.S. Cl. ..... 446/175; 446/450; 446/335

[58] Field of Search ..... 446/135, 450, 446/335, 336, 368

[56] References Cited

U.S. PATENT DOCUMENTS 4,717,364 1/1988 Furukawa ..... 446/175
4,802,879 2/1989 Rissman et al. ..... 446/175
4,923,428 5/1990 Curran ..... 446/175
5,209,695 5/1993 Rothschild ..... 446/175

*Primary Examiner*—Robert A. Hafer
*Assistant Examiner*—D. Neal Muir
*Attorney, Agent, or Firm*—Nixon & Vanderhye

[57] ABSTRACT

A programmable sound controlled toy including a programmable toy activity driver assembly having a plurality of selectable activities, an audio receiver and a memory for receiving and storing a user determined and audio communicated sequence of activity commands, and a controller for causing the driver assembly to operate the toy in accordance with the user determined sequence of activity commands.

20 Claims, 14 Drawing Sheets

SOUND CONTROLLED TOY

FIELD OF THE INVENTION

The present invention relates to sound controlled toys generally and more particularly to voice controlled toys.

BACKGROUND OF THE INVENTION

Various types of sound controlled toys are known and have been proposed. U.S. Pat. No. 5,209,695, to one of the present inventors, describes a voice controlled toy which operates on word counting rather than word recognition. The disclosure of U.S. Pat. No. 5,209,695 is hereby incorporated herein by reference. Other types of voice controlled toys, such as those employing word recognition, are also known as are various other types of sound controlled toys.

SUMMARY OF THE INVENTION

The present invention seeks to provide a sound-controlled toy having features not envisioned in the prior art.

There is thus provided in accordance with a preferred embodiment of the present invention a programmable sound controlled toy including a programmable toy activity driver assembly having a plurality of selectable activities, an audio receiver and a memory for receiving and storing a user determined and audio communicated sequence of activity commands, and a controller for causing the driver assembly to operate the toy in accordance with the user determined sequence of activity commands.

In accordance with one embodiment of the present invention, the driver assembly comprises a mechanical driver, an audio output driver and a visual output driver.

Further in accordance with a preferred embodiment of the present invention, each activity comprises a predetermined series of actions.

Further in accordance with a preferred embodiment of the present invention, the controller has at least first and second user selectable modes of operation. In a first mode of operation, the user provides a desired sequence of sound commands corresponding to a desired sequence of activities. Upon completion of the sequence, the user provides an execute command and the toy carries out the desired sequence of activities.

In a second mode of operation the controller causes the toy to carry out each activity upon provision of a corresponding sound command and the memory stores a predetermined number of such commands. Upon provision of an execute command, the toy repeats the predetermined number of activities in the order that the commands were given.

The controller may be responsive to sound in one of a number of ways. It may employ, for example, word counting as taught in U.S. Pat. No. 5,209,695. Alternatively, it may employ word recognition. It may be only voice responsive or responsive to both voice and other sounds or it may be responsive only to non-voice commands. Controllers responsive to sound in other ways are also within the scope of the present invention.

Throughout the specification and claims, the term "toy" is used in a broad sense so as to include all kinds of playthings, such as games.

BRIEF DESCRIPTION OF THE DRAWINGS

The present invention will be understood and appreciated from the following detailed description, taken in conjunction with the drawings in which.

Figure 8:
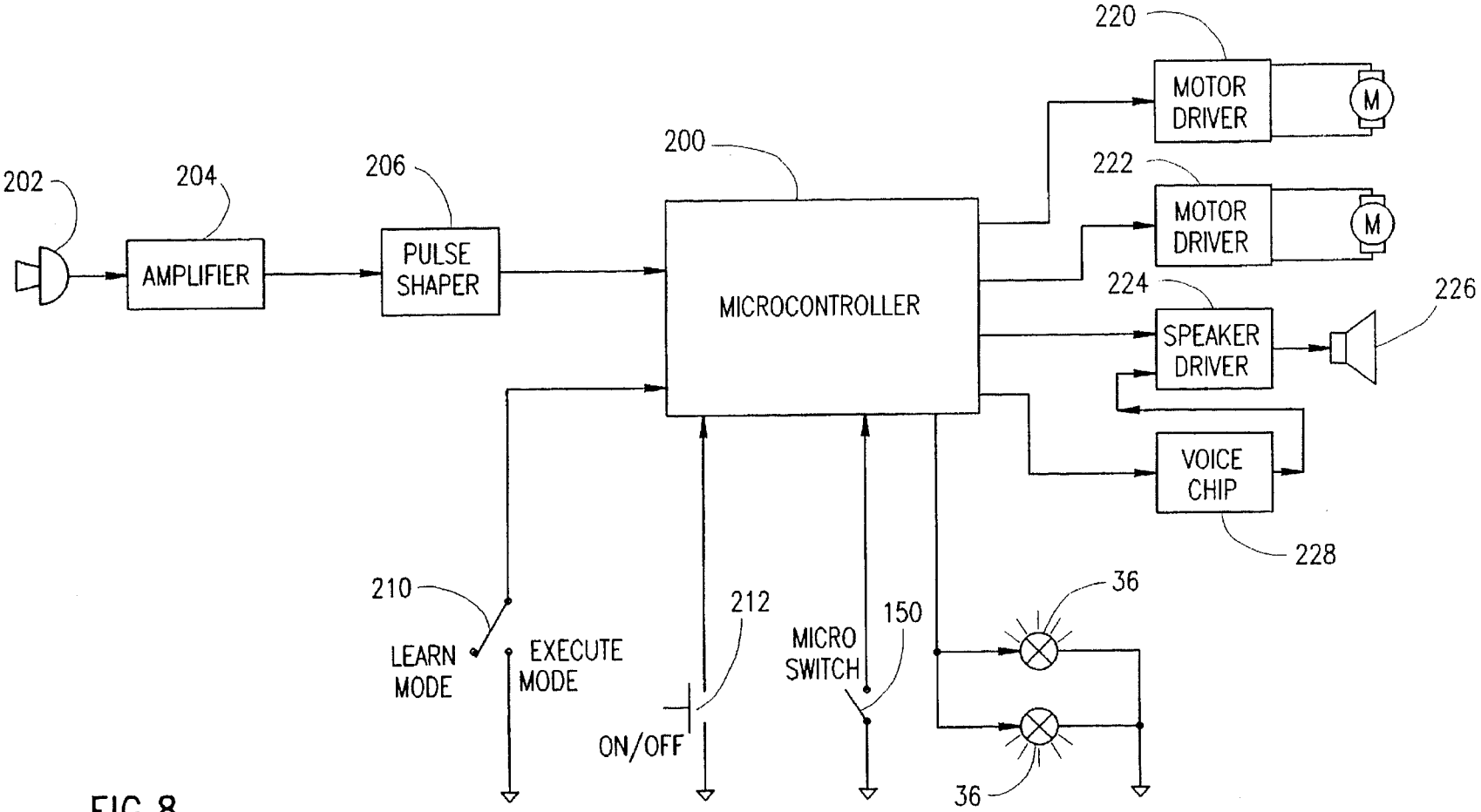
FIG. 8 is a block diagram illustration of operational electronics employed in the invention.
Figure 9A:
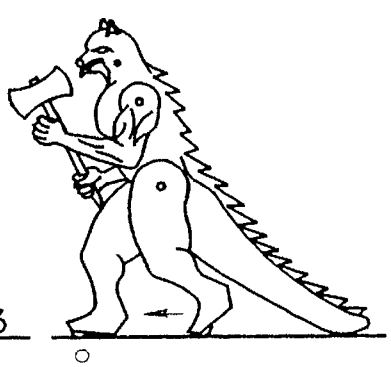
FIGS. 9A, 9B, 9C, 9D and 9E illustrate a series of mechanical movements corresponding to at least part execution of a GO command.
Figure 9B:
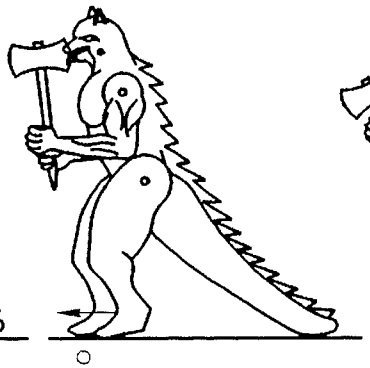
Figure 9C:
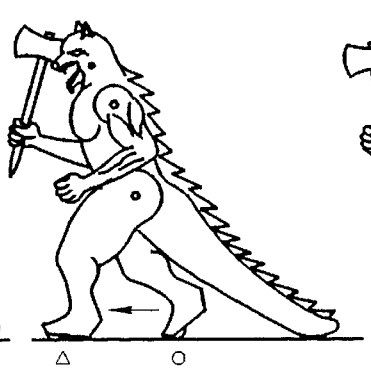
Figure 9D:
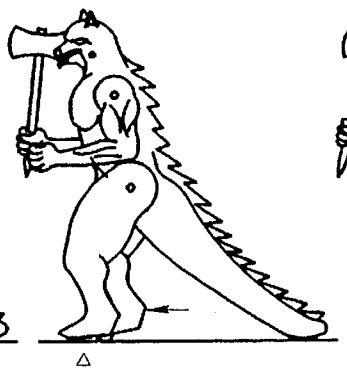
Figure 9E:
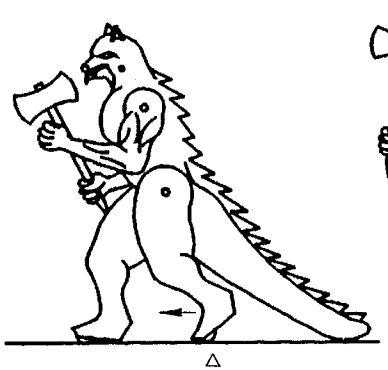
Figures 10A, 10B, 10C, 10D, 10E:
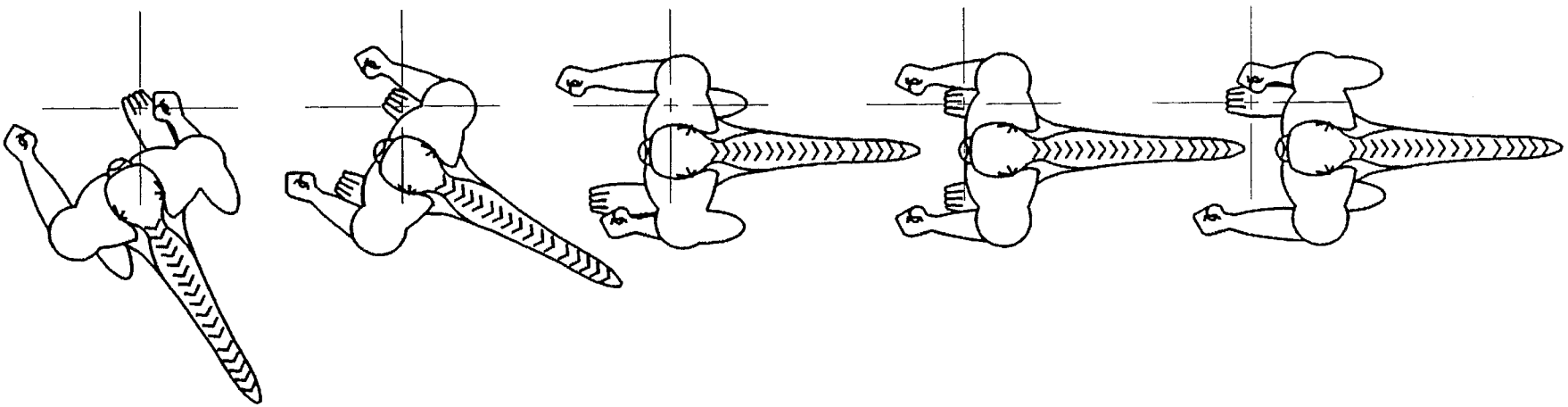
FIGS. 10A, 10B, 10C, 10D and 10E illustrate a series of mechanical movements corresponding to execution of a TURN AROUND command.

Appendix A is a netlist and bill of materials for a predetermined embodiment of the circuitry of FIG. 8; and Appendix B is a hexadecimal code listing of the software contained in the microcontroller 200 forming part of the circuitry of FIG. 8.

DETAILED DESCRIPTION OF A PREFERRED EMBODIMENT

Figure 1:
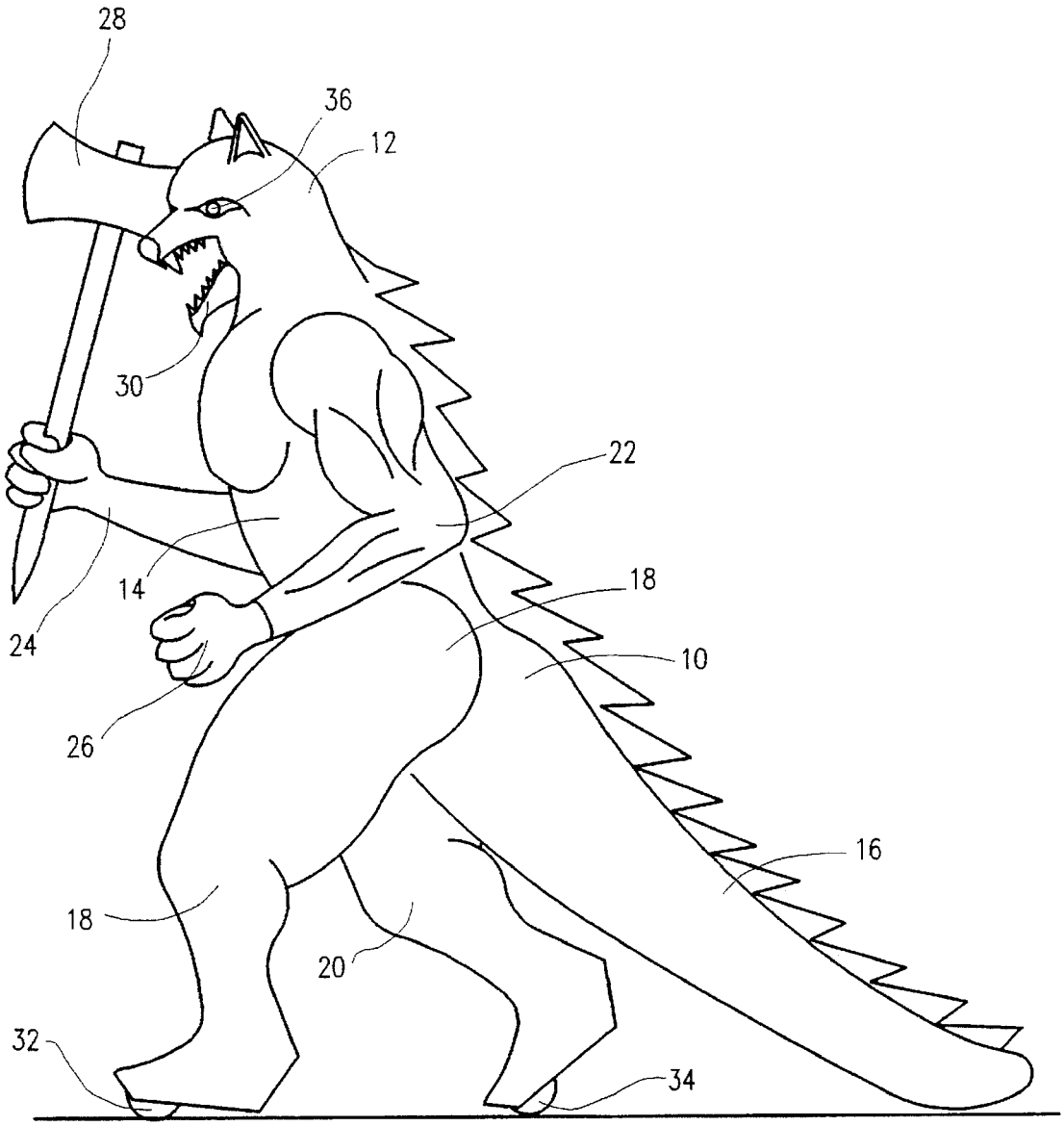
FIG. 1 is a pictorial illustration of a toy constructed and operative in accordance with a preferred embodiment of the present invention.

Reference is now made to FIG. 1, which illustrates a sound controlled toy constructed and operative in accordance with a preferred embodiment of the present invention. The sound controlled toy here is shown in the form of a dinosaur-type monster, it being appreciated that the toy may have any desired suitable fanciful or representative configuration.

In the illustrated embodiment, the toy comprises a main body portion 10, typically including a head 12, a torso 14 and a tail 16. A pair of legs 18 and 20 are pivotably mounted on the main body portion 10, as are a pair of arms 22 and 24. Arm 22 may include a hand portion 26 which is rotatable about the forearm and arm 24 may include two portions which are hinged together at the elbow, thus providing enhanced posability. A hatchet or other accessory 28 may be mounted in an aperture formed in the hand of arm 24.

A lower jaw portion 30 is pivotably and drivably mounted in the head 12. Leg 18 is formed with a roller 32 which is constrained to rotation only in a single direction. Leg 20 is formed with a roller 34 which is constrained to rotation only in a single direction and which is selectably lockable against rotation during turning action of the toy.

The head 12 is preferably formed with illuminatable eyes 36.

Figure 2A:
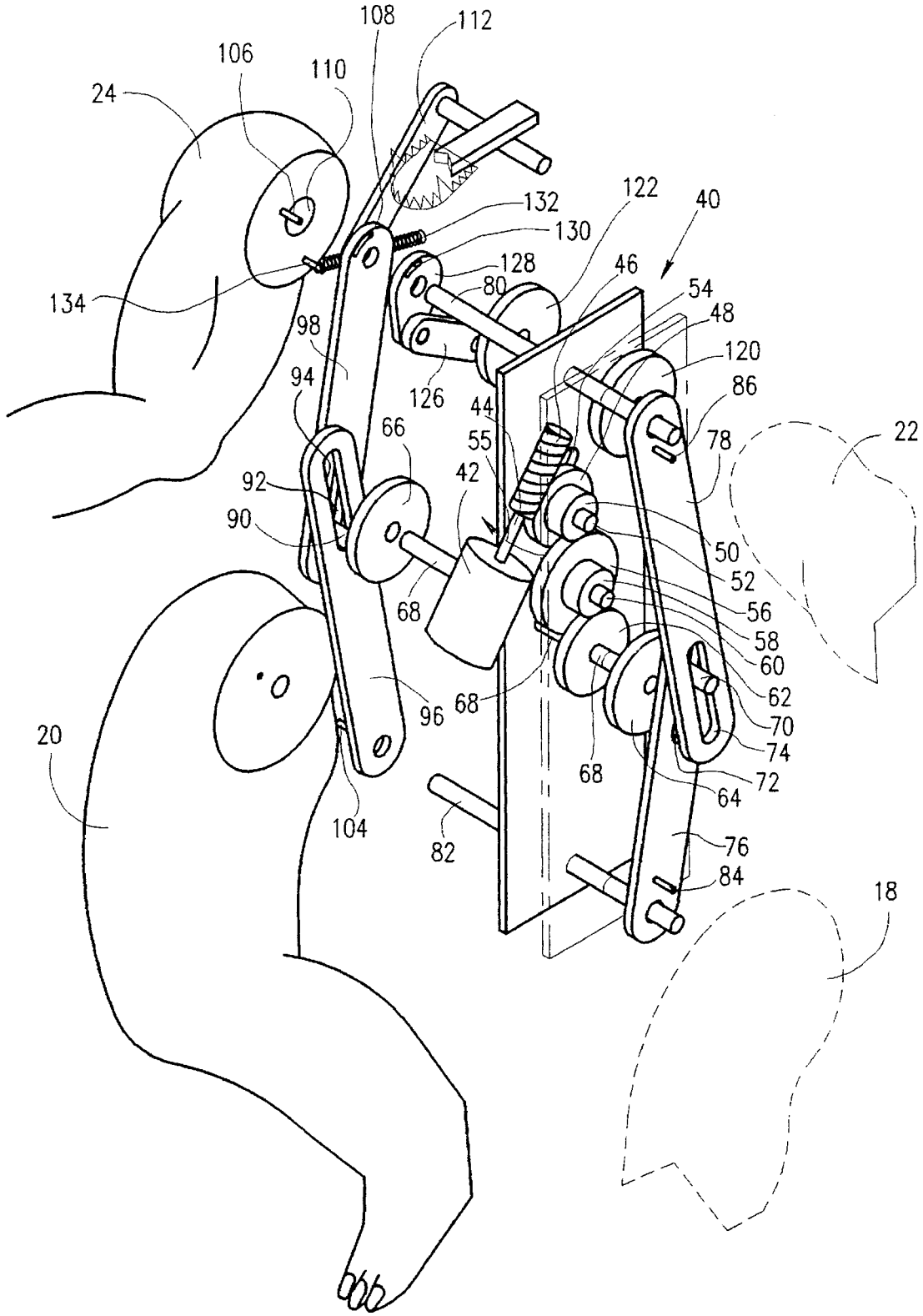
FIGS. 2A and 2B are simplified respective exploded and sectional view illustrations of mechanical interconnections between the arms and the legs of the toy of FIG. 1.
Figure 2B:
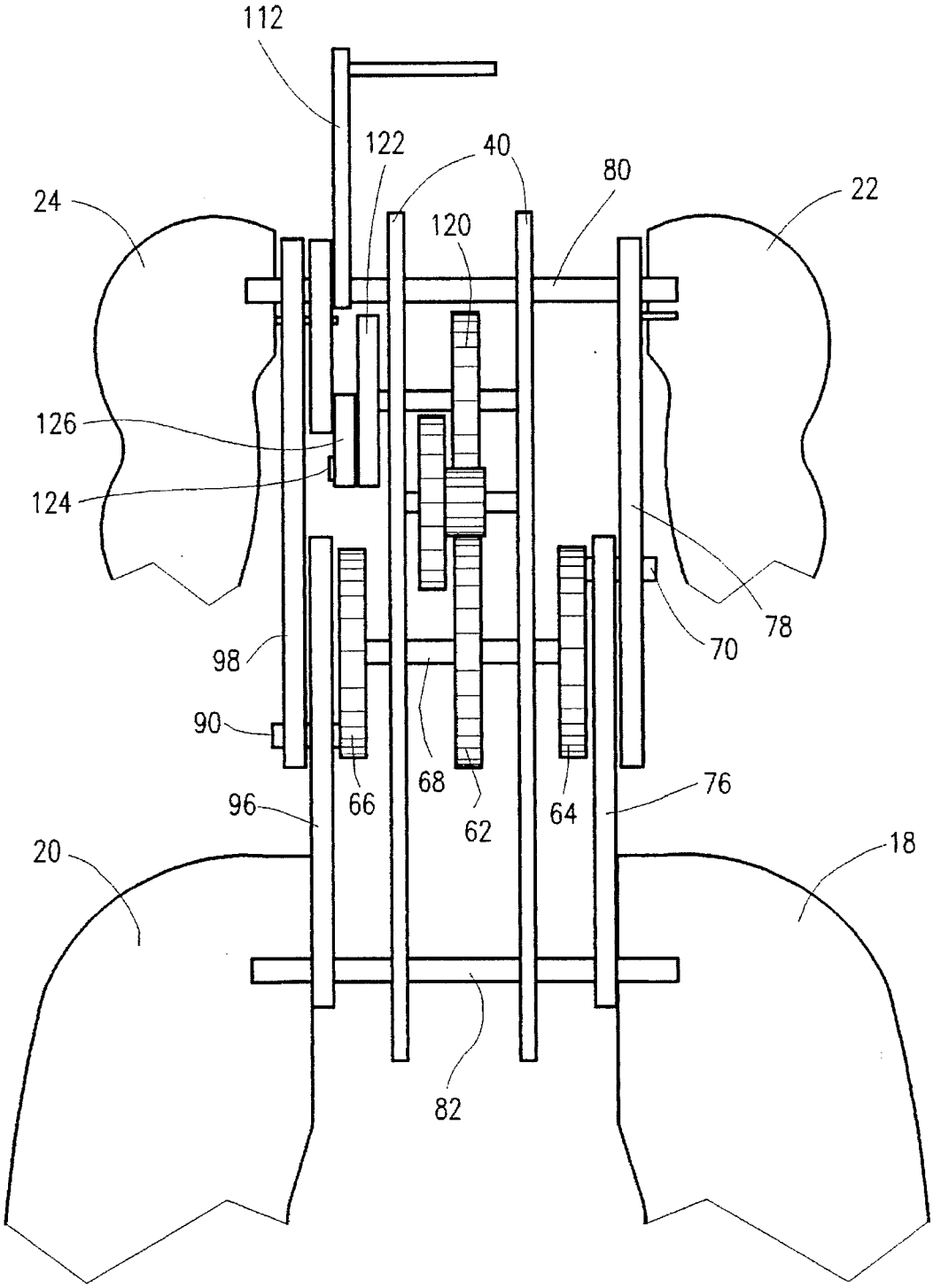
Figure 3A:
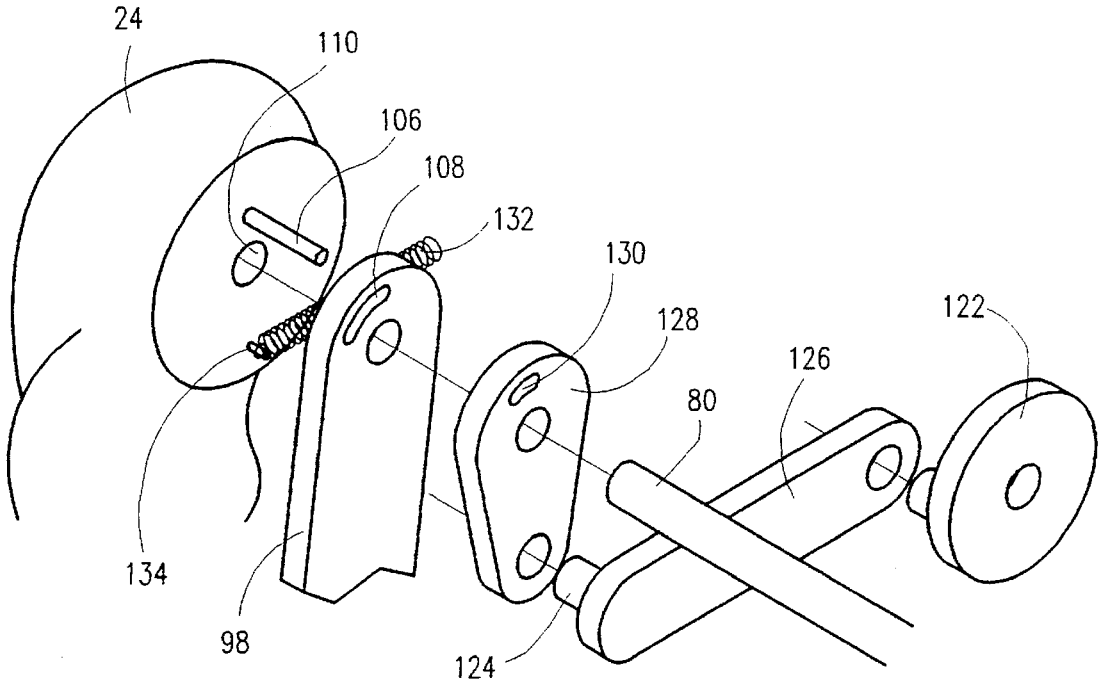
FIGS. 3A and 3B are respective exploded and assembled illustrations of right arm drive apparatus employed in the toy of FIGS. 1 and 2.
Figure 3B:
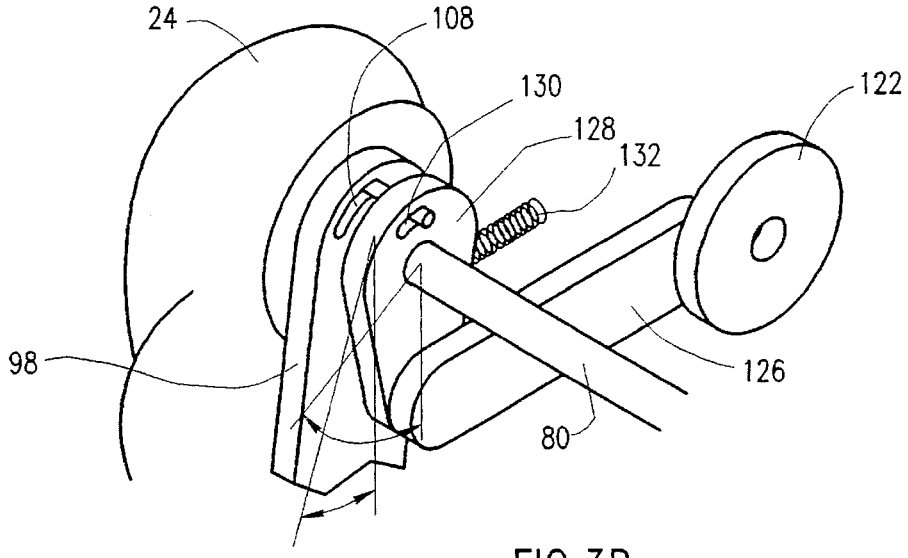

Reference is now made to FIGS. 2A and 2B, which illustrate the general drive mechanism of the toy of FIG. 1. The drive mechanism preferably comprises a double plate support assembly 40 which is typically fixedly mounted, as by screws, onto the main body portion and resides interiorly thereof. A reversible drive motor 42 is fixedly mounted onto support assembly 40 and is provided with an output shaft 44 having fixed thereto a worm gear 46.

The worm gear 46 drivingly engages a gear 48, which is fixed to another gear 50 on a common shaft 52 which is slidable along slots 54 formed in both plates of assembly 40. During locomotion of the toy, when the motor 42 is turning in a direction indicated by an arrow 55, gear 50, which is driven by rotation of gear 48, engages and drives a gear 56, which is fixed to another gear 58 on a common shaft 60, which is pivotably mounted in mounting apertures (not shown) in both plates of assembly 40. Gear 58, which is driven by rotation of gear 56, engages and drives a gear 62, which is fixed to a pair of cam drivers 64 and 66 and mounted together therewith on a common shaft 68, pivotably mounted in mounting apertures (not shown) in both plates of assembly 40.

Fixedly mounted onto cam driver 64 and extending parallel to shaft 68 is a cam driver pin 70 which engages respective cam slots 72 and 74 in a pair of cams 76 and 78. Cam 78 is pivotably mounted onto an arm support shaft 80, which is fixed to assembly 40 and extends perpendicular to the plates thereof. Cam 76 is pivotably mounted onto a leg support shaft 82, which is fixed to assembly 40 and extends perpendicular to the plates thereof.

A mounting pin 84, fixed onto cam 76 and a free end of shaft 82 are inserted into corresponding recesses in a base surface of leg 18. Pin 84 is operative to transmit the rotational motion of cam 76 to the leg 18 and to cause it to pivot about axis 82, to which it is pivotably mounted.

A mounting pin 86, fixed onto cam 78 and a free end of shaft 80 are inserted into corresponding recesses in a base surface of arm 22. Pin 86 is operative to transmit the rotational motion of cam 78 to the arm 22 and to cause it to pivot about axis 80, to which it is pivotably mounted.

Fixedly mounted onto cam driver 66 and extending parallel to shaft 68 is a cam driver pin 90 which engages respective cam slots 92 and 94 in a pair of cams 96 and 98. Cam 98 is pivotably mounted onto arm support shaft 80. Cam 96 is pivotably mounted onto leg support shaft 82.

A mounting pin 104, fixed onto cam 96 and a free end of shaft 82 are inserted into corresponding recesses in a base surface of leg 20. Pin 104 is operative to transmit the rotational motion of cam 96 to the leg 20 and to cause it to pivot about axis 82, to which it is pivotably mounted.

A mounting pin 106, fixed to a base surface of arm 24 extends into a slot 108 extending along a circumferential path in cam 98 about shaft 80. A free end of shaft 80 is inserted into a corresponding recess 110 in the base surface of arm 24. Pin 106 is operative to transmit some of the rotational motion of cam 98 to the arm 24 and to cause it to pivot about axis 80, to which it is pivotably mounted.

Fixedly attached to arm 24 and arranged for movement together therewith is a linkage 112 which is coupled to the lower jaw 30 (FIG. 1) for driving movement thereof.

When locomotion of the toy is not to take place, and the motor 42 rotates in a direction opposite to that indicated by arrow 55, gear 50, which is driven by rotation of gear 48, engages and drives a gear 120, which is fixed to a cam driver 122 on a common shaft 122, which is pivotably mounted on assembly 40.

Cam driver 122 includes a transversely extending cam pin 124 which engages a linkage member 126, which in turn drivingly engages a cam 128, which is pivotably mounted on shaft 80. Cam 128 is provided with a circumferentially extending groove 130 centered about shaft 80, which is engaged by pin 106. The arrangement is such that rotation of cam driver 122 provides reciprocal rotation of arm 24 as in a chopping movement. Typically, this motion is of greater frequency and amplitude that the normal reciprocal movement of arm 24 during locomotion of the toy.

A spring 132 which extends from a fixed location on assembly 40 to a spring mounting pin 134 is operative to urge arm 24 into an orientation such that pin 106 resides at a given end of at least one of grooves 108 and 130.

Reference is made additionally to FIGS. 3A, 3B, and 4A–4C, which illustrate the mechanical interconnections to arm 24 with enhanced clarity. A consideration of FIG. 3B indicates that two different cams, 98 and 128 are pivotably mounted about the same axis, defined by shaft 80 and provide different movements of the arm 24 thereabout. Specifically, due to the shorter circumferential extent of groove 130 in cam 128, as compared with groove 108 in cam 98, angular rotations of the two cams provide different amplitude angular rotations of the arm.

Figure 4C:
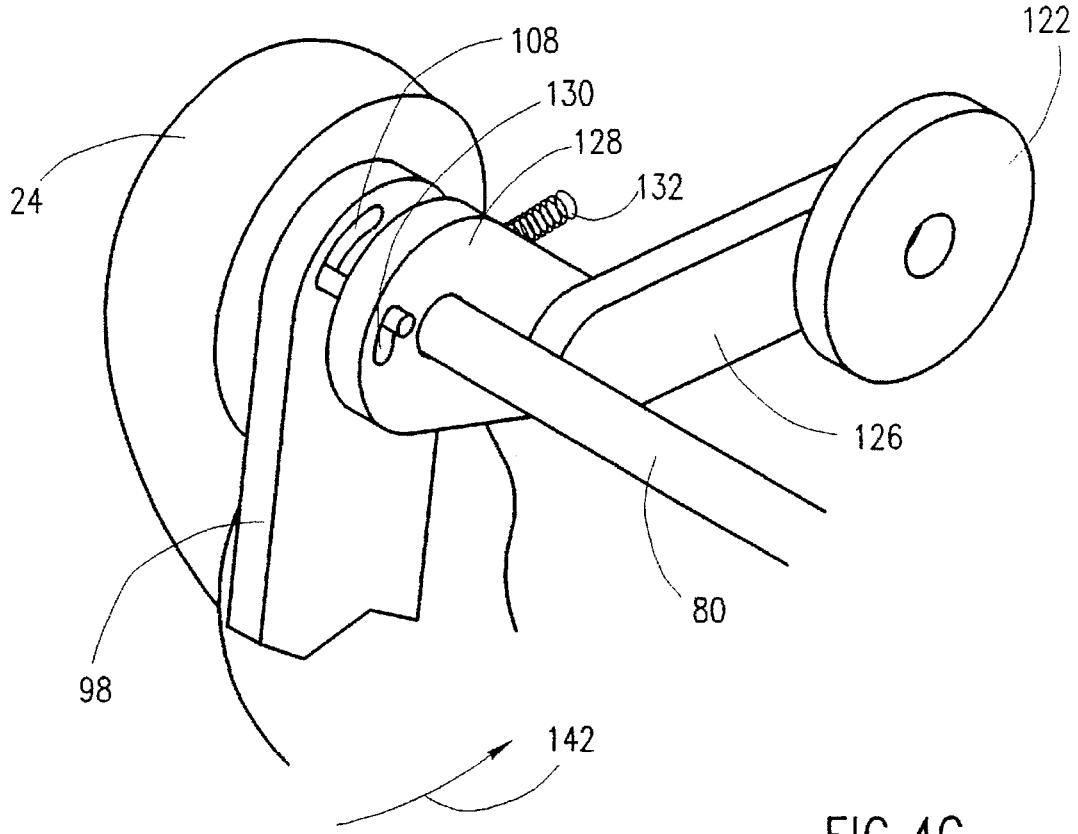
FIGS. 4A, 4B, and 4C are illustrations of the right arm drive apparatus of FIGS. 3A and 3B in various different operative orientations.
Figure 4A:
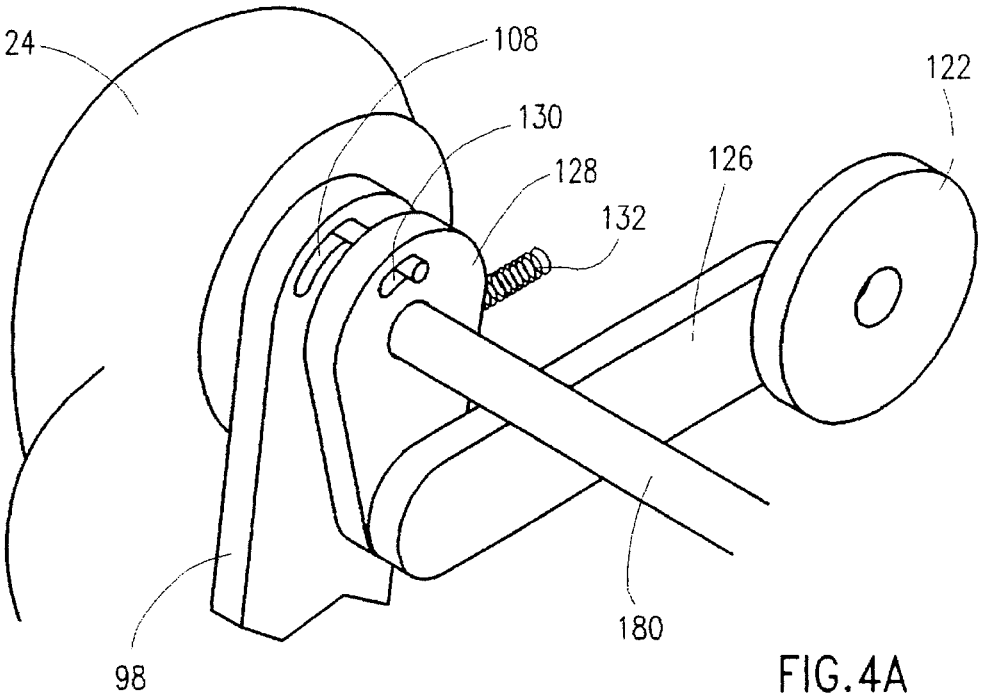
Figure 4B:
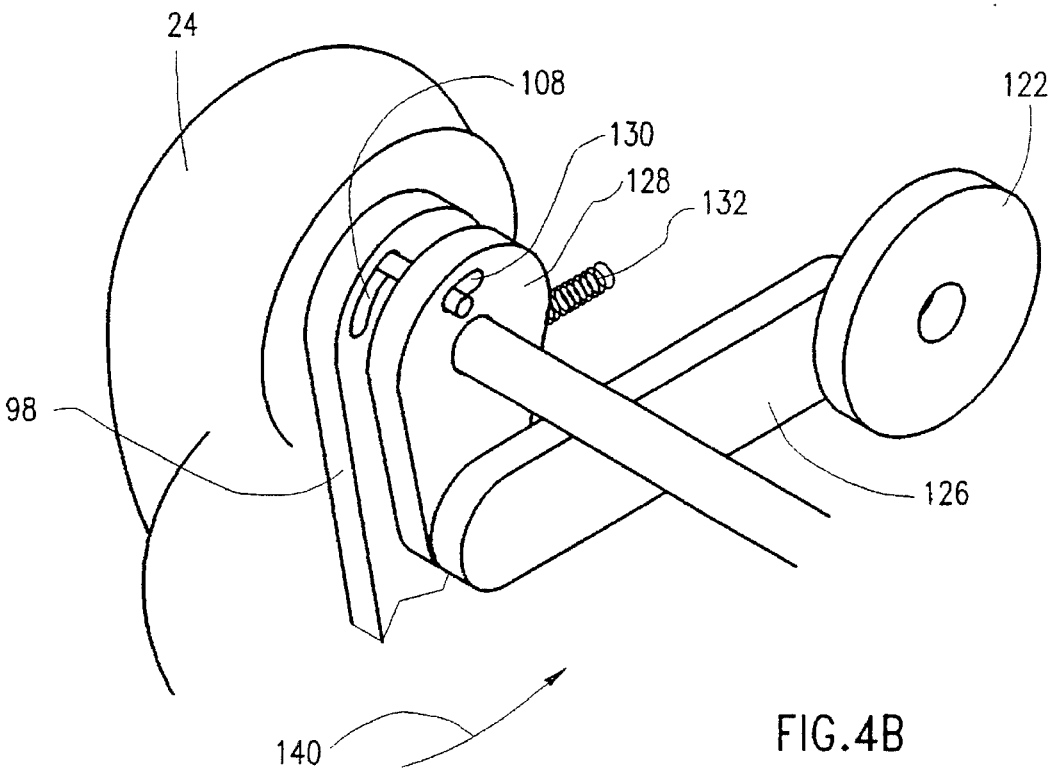

FIG. 4A illustrates an at rest, non-driven orientation of arm 34. FIG. 4B illustrates driving of arm 24 by cam 98 in a direction indicated generally by an arrow 140. FIG. 4C illustrates driving of arm 24 by cam 128 in a direction indicated generally by an arrow 142.

Figure 5B:
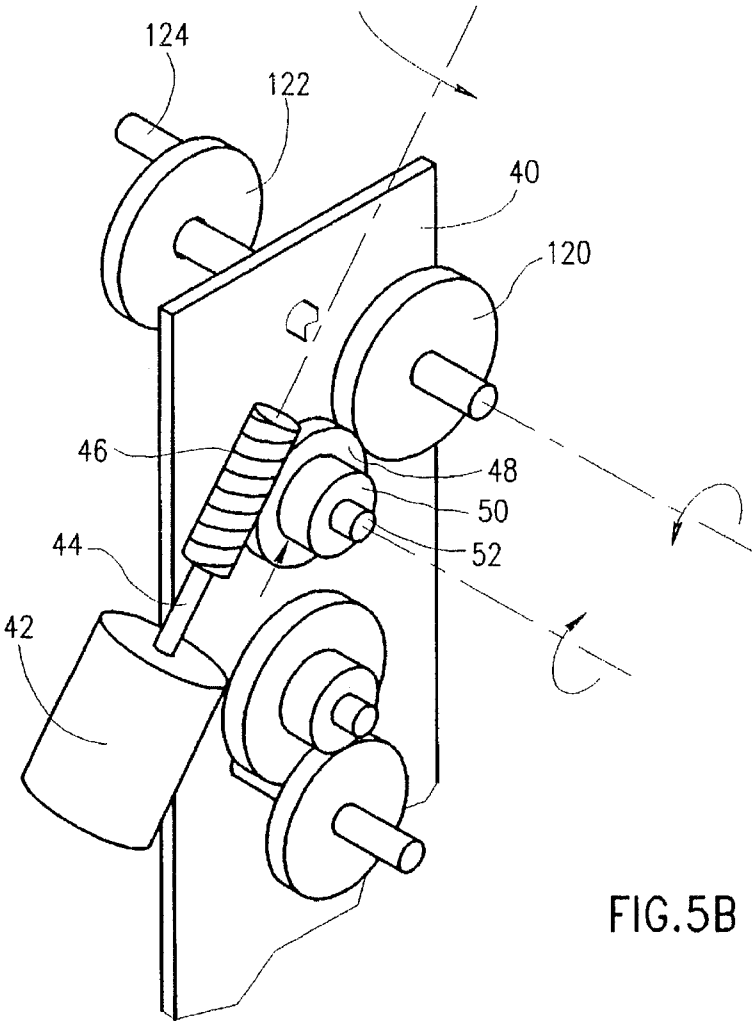
FIGS. 5A and 5B are illustrations of a motor drive assembly arranged for driving in two different motor drive directions respectively.
Figure 5A:
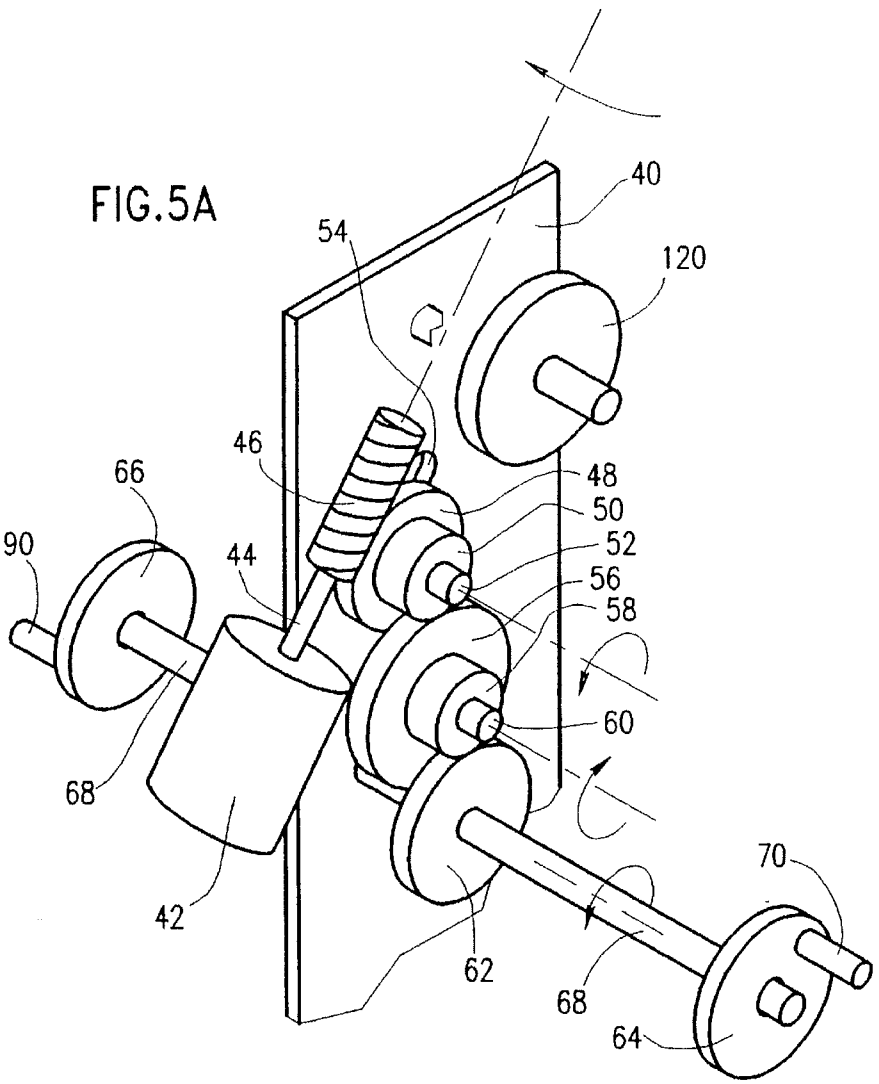

FIGS. 5A and 5B illustrate the selectable gear engagement of the apparatus of FIGS. 2A and 2B with enhanced clarity. FIG. 5A illustrates the gear engagement orientation for locomotion of the toy, while FIG. 5B illustrates how the engagement of gear 48 by worm gear causes gear 48 to move upward in slot 54 into driving engagement with gear 120.

Figure 6B:
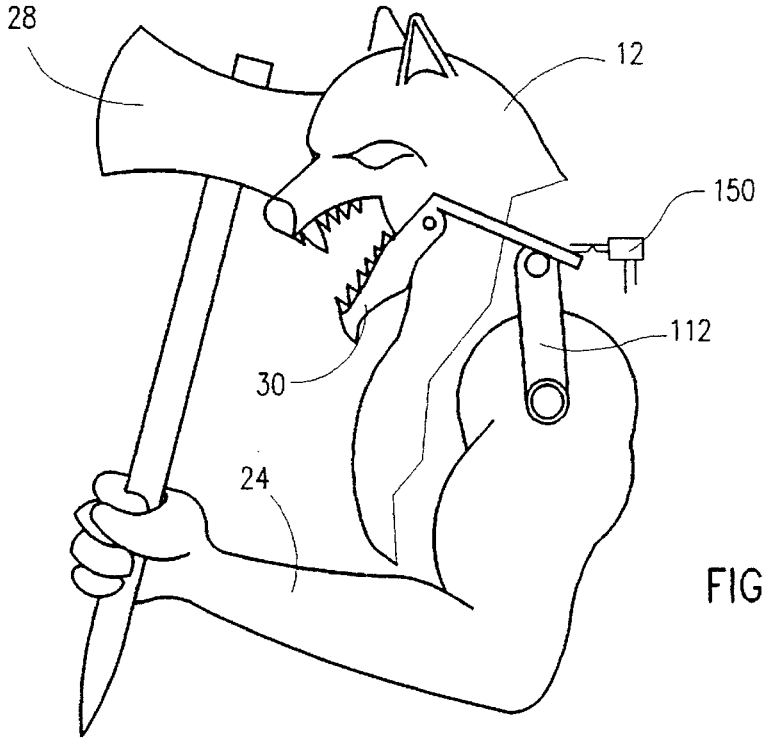
FIGS. 6A and 6B are illustrations of right arm, mouth and microswitch connections in two different operative orientations.
Figure 6A:
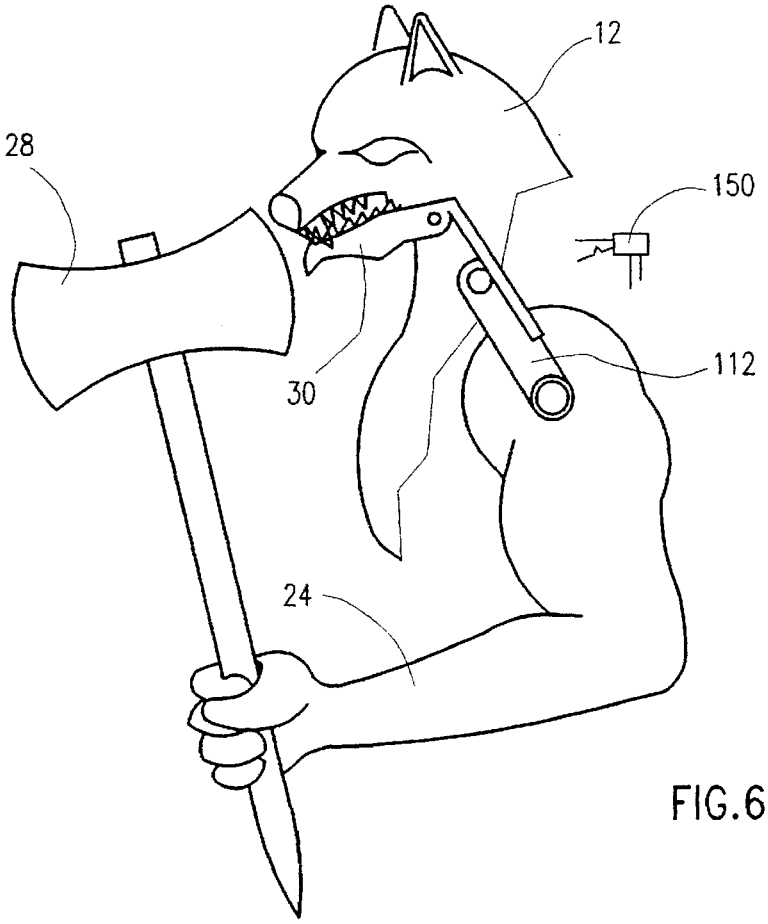

Reference is now made to FIGS. 6A and 6B, which illustrate the linkage between the motion of arm 24 and lower jaw portion 30. It is seen that a microswitch 150 is arranged in operative engagement with linkage 112 for sensing the position of the jaw portion 30 and of arm 24, as well as of the remaining movable elements in the toy, which are all coupled together via the mechanism of FIGS. 2A and 2B.

Figure 7A:
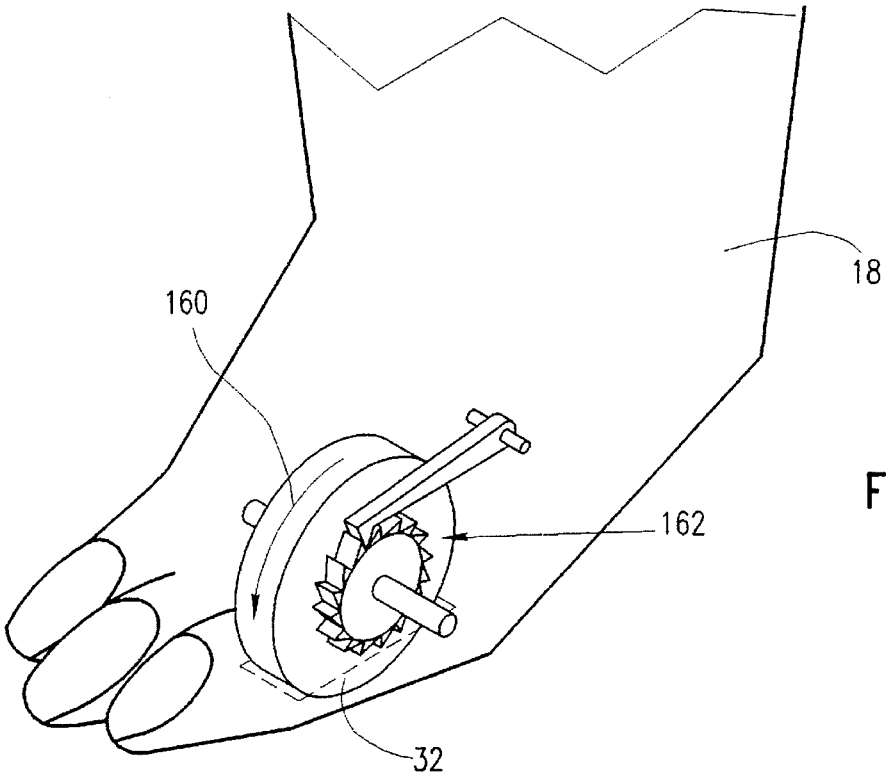
FIGS. 7A and 7B are respective illustrations of left and right foot mechanisms.
Figure 7B:
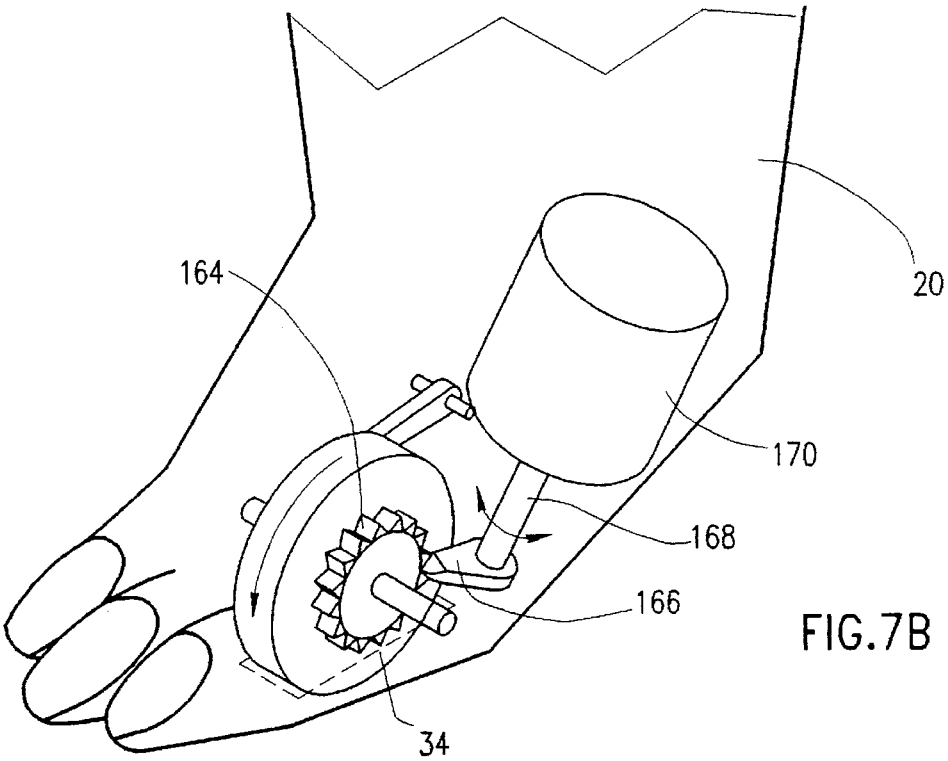

Reference is now made to FIGS. 7A and 7B, which illustrate the structure of the rollers 32 and 34. As noted above, and as seen in FIG. 7A, roller 32 is restricted to rotation in one direction only, as indicated by an arrow 160. Restriction to one directional rotation is provided by a conventional ratchet mechanism 162.

FIG. 7B illustrates roller 34 which may be identical to roller 32 but which is also provided with a selectable locking mechanism comprising a gear 164, fixed to roller 34 and a gear locking member 166 which is fixed to the output shaft 168 of a motor 170 and is selectably brought into and out of engagement with gear 164 for selectable locking of roller 34 against rotation.

Reference is now made to FIG. 8, which is a block diagram illustration of operational electronics employed in a preferred embodiment of the invention. A microcontroller 200, such as a PIC 16C56, commercially available from Microchip Technology Inc. of Chandler, Ariz., U.S.A. receives a sound input via a conventional microphone 202, which outputs to the microcontroller 200 via an amplifier 204, such as a Motorola MC14069UB and a pulse shaper 206.

Associated with the microcontroller are a mode switch 210 having selectable LEARN MODE and EXECUTE MODE positions, an ON/OFF switch 212, and microswitch 150 (FIGS. 6A and 6B) which monitors the position of the mechanical mechanism of the toy. The microcontroller 200 provides an illumination output to the illuminatable eyes 36 (FIG. 1) as well as the following drive outputs:

an output via a motor driver 220 to motor 42 (FIG. 2A)

an output via a motor driver 222 to motor 170 (FIG. 7B)

The microcontroller also provides a sound output indication via a speaker driver 224 to a loudspeaker 226. The speaker driver may also receive voice inputs, triggered by a signal from microcontroller 200, from a voice chip 228, such as an ISD 1020A, commercially available from ISD Information Storage Devices Inc. of San Jose, Calif., and provide corresponding voice outputs via loudspeaker 226.

A net-list of a preferred embodiment of the circuitry of FIG. 8 is appended hereto as Appendix A. The net list is in Industry Standard Format Calay and includes a Bill of Materials setting forth the component values. A hexadecimal listing of the object code of the microcontroller 200 is appended hereto as Appendix B.

Reference is now made to FIGS. 9A, 9B, 9C, 9D and 9E which illustrate a series of mechanical movements corresponding to at least part execution of a GO or single word command. It is seen that the GO command comprises arm, leg and jaw movements with roller 34 unlocked. Three full cycles of two full steps each are preferably provided in response to a GO command. The "o" designation indicates the position of leg 20 and the "+" designation indicates the position of leg 18.

Reference is now made to FIGS. 10A, 10B, 10C, 10D and 10E which illustrate a series of mechanical movements corresponding to execution of a TURN AROUND or two-word command. It is seen that the TURN AROUND command typically comprises arm, leg and jaw movements with roller 34 locked by action of motor 170 (FIG. 7B). Three cycles, each producing approximately 45 degree rotation are typically provided in response to a TURN AROUND command. The cross hatching indication indicates the fixed position of leg 20.

Figure 11C:
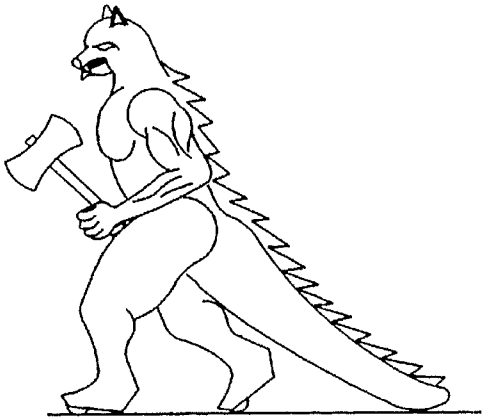
FIGS. 11A, 11B, 11C, illustrate a series of mechanical movements corresponding to execution of an ATTACK YOUR ENEMY command.
Figure 11B:
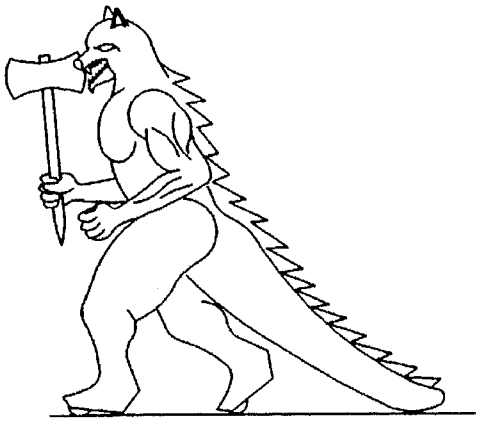
Figure 11A:
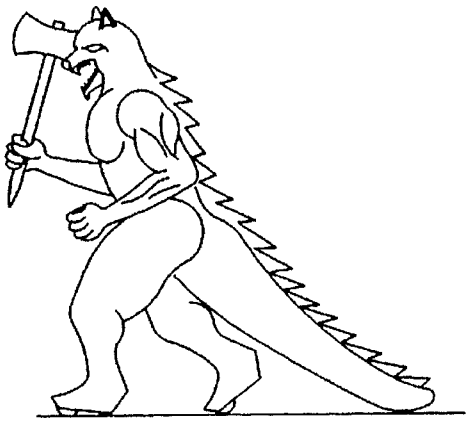

Reference is now made to FIGS. 11A, 11B, 11C, which illustrate a series of mechanical movements corresponding to execution of an ATTACK YOUR ENEMY or three word command. It is seen that the ATTACK YOUR ENEMY command typically comprises arm and jaw movements. Six cycles, each including the movements shown in FIGS. 11A–11C are typically provided in response to an ATTACK YOUR ENEMY command.

It is appreciated that all of the above movements are preferably accompanied by periodic eye illumination and sounds, preferably including roars or other voice outputs.

Figure 12A:
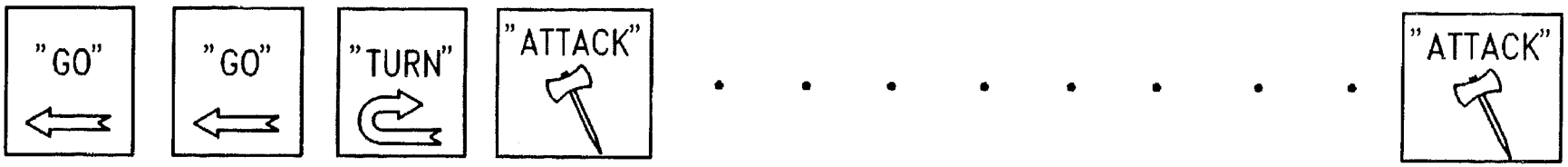
FIGS. 12A, 12B and 12C illustrate three exemplary sequences of activities that can be learned and then executed in the learned order.
Figure 12B:
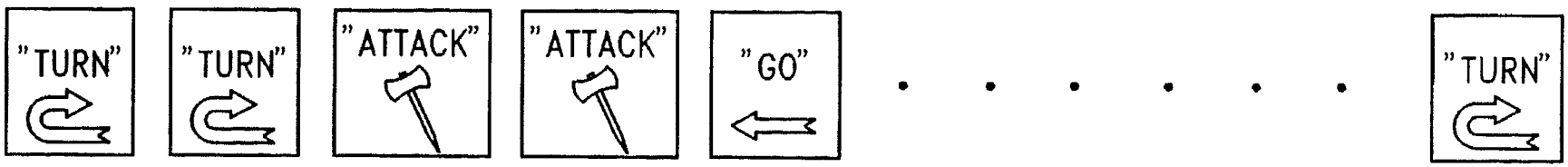
Figure 12C:
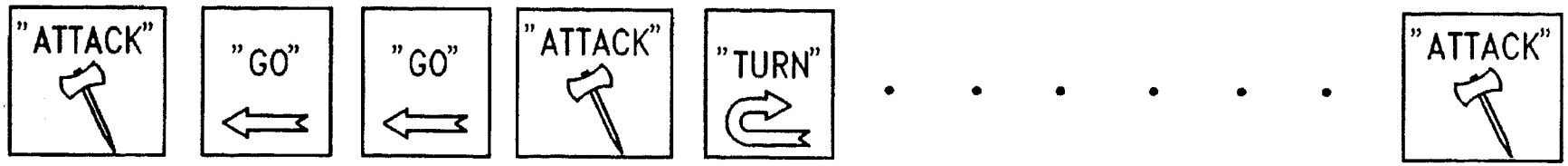

Reference is now made to FIGS. 12A, 12B and 12C which illustrate three exemplary sequences of activities that can be learned and then executed in the learned order. Preferably the toy can remember a plurality of earlier received commands. In accordance with a preferred embodiment of the invention, the toy remembers the last up to 20 commands.

In the LEARN mode, the toy remembers the commands and acknowledges them by a voice output but does not execute them as they are received, but rather only when a SERIES EXECUTE command, such as a four word command is received. In the EXECUTE mode, the toy executes each command as it is received and thereafter, in response to a SERIES EXECUTE command, executes the last up to 20 commands.

Preferably, the toy stores in a non-volatile memory a predetermined series of commands which can be carried out in response to receipt of a SERIES EXECUTE command even when no earlier commands were received.

The controller may be responsive to sound in one of a number of ways. It may employ, for example, word counting as taught in U.S. Pat. No. 5,209,695. Alternatively, it may employ word recognition. It may be only voice responsive or responsive to both voice and other sounds or it may be responsive only to non-voice commands. Controllers responsive to sound in other ways are also within the scope of the present invention.

It will be appreciated by persons skilled in the art that the present invention is not limited to what has been particularly shown and described hereinabove. Rather the scope of the present invention is defined only by the claims which follow:

APPENDIX A

| | |
|---|---|
| /N00001 | C23(1) Q11(COLLECTOR) MOTOR1(1) Q10 (COLLECTOR); |
| /N00002 | Q13(COLLECTOR) C23(2) MOTOR1(2) Q12 (COLLECTOR); |
| /N00003 | Q13(BASE) Q18(EMITTER); |
| /N00004 | R43(2) R34(1) Q19(COLLECTOR); |
| /N00005 | R34(2) Q11(BASE); |
| /N00006 | R58(1) C37(1) U2(16); |
| /N00007 | R22(2) C32(1) U2(4) SW2(1); |
| /N00008 | R47(1) U2(12); |
| /N00009 | Q19(BASE) R47(2); |
| /N00010 | Q12(BASE) Q19 (EMITTER); |
| /N00011 | R48(1) U2(17); |
| /N00012 | Q18(BASE) R48(2); |
| /N00013 | Q18(COLLECTOR) R44(1) R57(1); |
| /N00014 | R44(2) Q10(BASE); |
| /N00015 | J7(1) U2(1); |
| /N00016 | U2(18) R35(1); |
| /N00017 | J6(1) U2(2) U100(9); |
| /N00018 | J4(1) U2(8) U100(6); |
| /N00019 | U2(6) U1(10); |
| /N00020 | U2(13) R52(1); |
| /N00021 | U2(7) J5(1) U100(23) U100(24); |
| /N00022 | R90(1) U2(11); |
| /N00023 | R90(2) Q30(BASE); |
| /N00024 | R35(2) Q22(BASE); |
| /N00025 | U2(9) SW1(COMMON); |
| /N00026 | U2(10) SW3(COMMON); |
| /N00027 | Q30(COLLECTOR) MOTOR2(2) C90(1); |
| /N00028 | U100(15) R401(1); |
| /N00029 | U100(28) U100(27) C220(1) C230(1) R402(1); |
| /N00030 | C190(1) R401(2); |
| /N00031 | C35(2) R39(2) R38(1) U1(11); |
| /N00032 | C190(2) RP170(A); |
| /N00033 | U500(3) RP170(WIPER); |
| /N00034 | X2(1) R53(2) C1(1); |
| /N00035 | U1(1) C1(2) R2(2); |
| /N00036 | U1(2) C2(1) R2(1); |
| /N00037 | C2(2) U1(3) R3(1); |
| /N00038 | C3(1) U1(4) R3(2); |
| /N00039 | C3(2) R70(2) RP39(2) U1(5); |
| /N00040 | U1(6) D2(CATHODE); |
| /N00041 | D2(ANODE) R39(1); |
| /N00042 | U500(5) C200(1) C210(1); |
| /N00043 | SP1(1) C210(2); |
| /N00044 | R28(1) C200(2); |
| /N00045 | R52(2) Q21(BASE); |
| /N00046 | Q21(COLLECTOR) LP1(1); |
| /N00047 | BT1(–) BT2(+); |
| /VCC | C30(1) C29(1) U1(9) U1(13) R91(1) SW3(NC), SW1(NC) U2(14) R22(1) R58(2) R54(1); |
| /VBB | Q21(EMITTER) R91(2) R92(2) BT1(+) R402(2), J2(1) Q30(EMITTER) Q13(EMITTER) Q11 (EMITTER); |
| /GND | LP1(2) BT2(–) C30(2) C29(2) R27(2) SP1(2) J1(1) SW3(NO) SW1(NO) C90(2) MOTOR2(1) Q22(EMITTER) U2(3) U2(5) Q10(EMITTER) R57(2) Q12(EMITTER) C32(2) C37(2) SW2(2); |
| /V– | C34(2) U1(7) RP39(1) U500(2) RP170(B) U500(4), X2(2) C230(2) C220(2) J3(1) U100(26) U100(13), U100(12) U100(10) U100(5) U100(4), |

APPENDIX A-continued

| | |
|---|---|
| | 8100(3) U100(2) U100(1) Q22(COLLECTOR); |
| /VCC1 | U500(6) U100(16); |
| /VDD | C34(1) R92(1) U1(14) R38(2) C35(1) R70(1), R53(1); |

Bill Of Materials

| Item | Quantity | Reference | Part | |
|---|---|---|---|---|
| 1 | 2 | BT1, BT2 | BATTERIES | |
| 2 | 8 | C1, C2, C3, C23, C30, C34, C35, C90 | 100n | |
| 3 | 1 | C29 | 100u | |
| 4 | 1 | C32 | 4.7u | |
| 5 | 1 | C37 | 22p | |
| 6 | 2 | C230, C190 | 0.1u | |
| 7 | 1 | C200 | 47n | |
| 8 | 2 | C210, C220 | 220u | |
| 9 | 1 | D2 | 1N914 | |
| 10 | 1 | J1 | GN1 | I/O PIN |
| 11 | 1 | J2 | VB1 | I/O PIN |
| 12 | 1 | J3 | V1 | I/O PIN |
| 13 | 1 | J4 | A0 | I/O PIN |
| 14 | 1 | J5 | PD1 | I/O PIN |
| 15 | 1 | J6 | A1 | I/O PIN |
| 16 | 1 | J7 | A2 | I/O PIN |
| 17 | 1 | LP1 | LAMP | |
| 18 | 1 | MOTOR1 | 3VDC, RE280 | |
| 19 | 1 | MOTOR2 | 3VDC, FA130 | |
| 20 | 2 | Q10, Q12 | KSC2328A | |
| 21 | 3 | Q11, Q13, Q30 | KSA928A | |
| 22 | 2 | Q18, Q21 | 2SA733 | |
| 23 | 1 | Q19 | 2SC945 | |
| 24 | 1 | Q22 | 2SC2001 | |
| 25 | 1 | RP39 | 50K | |
| 26 | 1 | RP170 | 5K | |
| 27 | 2 | R2, R3 | 1.0M | |
| 28 | 2 | R22, R70 | 100K | |
| 29 | 4 | R28, R91, R92, R402 | 10 | |
| 30 | 2 | R34, R44 | 68 | |
| 31 | 3 | R35, R52, R90 | 180 | |
| 32 | 1 | R38 | 1M | |
| 33 | 3 | R39, R54, R57 | 11K | |
| 34 | 2 | R47, R48 | 1.0K | |
| 35 | 1 | R53 | 20K | |
| 36 | 1 | R58 | 5.2K | |
| 37 | 1 | R401 | 22 | |
| 38 | 1 | SP1 | 8 OHM, 0.5W | |
| 39 | 1 | SW1 | MICRO SWITCH | |
| 40 | 1 | SW2 | PUSHBUTTON | |
| 41 | 1 | SW3 | EXECUTE/LEARN | |
| 42 | 1 | U1 | MC14069UB | |
| 43 | 1 | U2 | PIC16C56RC | |
| 44 | 1 | U100 | ISD1020P | |
| 45 | 1 | U500 | LM386 | |
| 46 | 1 | X2 | COND MIC | |

APPENDIX B

```
:10000000070C02006100FA0C81000307030A0008D4
:100010000A02E20101080208010803080208308B5
:100020000008BD071F0A6A00060C8A0003063E0A84
:1000300008093B00A305C3040009AA02140A100C16
:10004000D9013C000F0C2B001C028B0003063E0A5A
:100050000B02240000023B000F0C7B014307A305A9
:10006000C304000900023B00F00C7B01BB033B0210
:100070004307A305C3040009AB02240A0008670074
:100080000009A7020A0C87000307400A00081A02A9
:10009000020F43074D0A7A00B90219020A0F4307FB
:1000A0007B0A0F0C240000023C000402EF0F430700
:1000B0005F0AF00C7C01BC031C022000730A0F0CC9
:1000C0007C01BC03E40000023F000F0C7F011C0216
:1000D0003F011F022000A40200023C00F00C7C0142
```

APPENDIX B-continued

```
:1000E000BC031C022000A402F90C84000307530A7D
:1000F000F900010C3A0000083A0243078B0A0F0C82
:10010000D901240000023C00F00C7C011B023C01E0
:100110001C022000990A0F0CD901240000023C00A7
:100120000F0C7C011B022A00AA030A023C011C02DC
:1001300020000000847097C09BA020008A304DD0674
:10014000020B7D00DD05BD05030C3E00310B3F09B0
:100150006D006E003F090607C60A080BCD06020BAC
:10016000AE02610067000009A7020606BB0A120C76
:100170087000307B30A040C87000306C10AEE00D8
:10018000AB0A120C87000306CC0AAB0A1B0BCD0688
:10019000020B00090009AB0A0E02030F4307D50A40
:1001A000030C3B0086074F0BF30ACE02DC0A010C5E
:1001B0003B0086074F0BF30A0E02020F4307E50AC6
:1001C000020C3B0086074F0BF30A0E02040F430795
:1001D000A70A86074F0B5D043D06F00A1109A70A1E
:1001E0003D04BD05EE0A090C3E005D07310B3D06DE
:1001F000310B1D055D05BD043D04A305C3040009C5
:100200009A09A70A0F0C2500E6052504DD04030062
:10021000670068000009E50C87000307110B670001
:10022000A802020C88000306CD05A7020607AE0A45
:10023000CD070A0BAE0ACD0467006800ED04000983
:10024000E50C87000307260B6700A802020C880054
:100250000306CD05A7020606C70ACD071F0BC70A6E
:10026000C70A6D00070C0200000C05000F0C2500EA
:10027000110C06003F0C26000F0C24006000A402A5
:10028000F90C840003073E0B79007A001E02040F6C
:100290004306610B1E02090F4307A70AF90A3D0531
:1002A0000E02040F4307590B1D06BD0511097D04FD
:1002B000A70ABD041D065E0B7D06610B040C3E0003
:1002C000310B7D05BD041D049A09460565056A00CC
:1002D0000E028A000306A70A260467006800610070
:1002E000FB0C81000307760B6100A7020702040FD5
:1002F00043077E0B6700800CA601A802040C88004F
:100300000307700B26056100FA0C81000307840BBC
:06031000AA02680BA70A17
:10040000670068006606160AC6050505070C0200A8
:1004100061006606150AFB0C81000307110AA7029A
:1004200061001F0C87000307090A020C0200C604C2
:10043000670046465041B02030F4307220A650693
:100440004604410A1B02020F4307400A46056504A1
:10045000410AA6046100390C810003072B0AA60596
:1004600061003A0C81000307310AA7020702960FC8
:1004700043073C0AA8026700030C88000307290A07
:100480000400E60469006700680060C000D041B02AC
:10049000030F43075D0A0504C6046100620C810076
:1004A00003074E0A05056100110C81000307540A79
:1004B0000C02060F4307990AB90ADB02880A0505F0
:1004C000C604A6041D0C3E00170C3F00610001028B
:1004D0009F000307A6051E0281000307670A1F028B
:1004E00081000307670AC605A6056100570C810055
:1004F0000306C604560C81000307760A5C0C8100D3
:100500000307760AC6040C02030F4307990AB90AC7
:100510000505C6056100620C810003078B0AC6044D
:10052000610011 0C81000307910A0C02030F4306BE
:10053000B90AA702A6050702960F4307A10AA80257
:100540006700080202 0F4307B30AA902800CA60144
:100550006800660 6AE0A26040D05B30A26050D07D7
:10056000B30A0D04AC02250C89000307470AA30453
:10057000020B2605E604C6040505A605A30400082B
:0207FE009E0A51
:00000001FF
```

We claim:

1. A sound programmable sound controlled toy including a programmable toy activity driver assembly having a plurality of selectable activities, an audio receiver and a memory for receiving and storing a user determined and audio communicated sequence of activity commands, and a controller for causing the driver assembly to operate the toy in accordance with the user determined sequence of activity commands, said controller including:

electronic circuitry responsive to a sequential set of audio inputs supplied in a user selected order, said sequential set of audio inputs corresponding to a plurality of activity commands, for causing the driver assembly to operate the toy in the user selected order following receipt of said sequential set of audio inputs.

2. Apparatus according to claim 1 and wherein the driver assembly comprises a mechanical driver, an audio output driver and a visual output driver.

3. Apparatus according to claim 1 and wherein each of said plurality of selectable activities comprises a predetermined series of actions.

4. Apparatus according to claim 2 and wherein each of said plurality of selectable activities comprises a predetermined series of actions.

5. Apparatus according to claim 1 and wherein said controller has at least first and second user selectable modes of operation.

6. Apparatus according to claim 2 and wherein said controller has at least first and second user selectable modes of operation.

7. Apparatus according to claim 3 and wherein said controller has at least first and second user selectable modes of operation.

8. Apparatus according to claim 4 and wherein said controller has at least first and second user selectable modes of operation.

9. Apparatus according to claim 5 and wherein in said first mode of operation, when the user provides a desired sequence of sound commands corresponding to a desired sequence of activities and upon completion of the sequence, provides an execute command and the controller causes the driver assembly to carry out the desired sequence of activities.

10. Apparatus according to claim 6 and wherein in said first mode of operation, when the user provides a desired sequence of sound commands corresponding to a desired sequence of activities and upon completion of the sequence, provides an execute command and the controller causes the driver assembly to carry out the desired sequence of activities.

11. Apparatus according to claim 7 and wherein in said first mode of operation, when the user provides a desired sequence of sound commands corresponding to a desired sequence of activities and upon completion of the sequence, provides an execute command and the controller causes the driver assembly to carry out the desired sequence of activities.

12. Apparatus according to claim 8 and wherein in said first mode of operation, when the user provides a desired sequence of sound commands corresponding to a desired sequence of activities and upon completion of the sequence, provides an execute command and the controller causes the driver assembly to carry out the desired sequence of activities.

13. Apparatus according to claim 5 and wherein in said second mode of operation the controller causes the toy to carry out each activity upon provision by the user of a corresponding sound command and causes the memory to store a predetermined number of such commands corresponding to a predetermined number of said plurality of selectable activities, whereby upon provision of an execute command, the toy repeats the predetermined number of activities in the order that the commands were given.

14. Apparatus according to claim 6 and wherein in said second mode of operation the controller causes the toy to carry out each activity upon provision by the user of a corresponding sound command and causes the memory to store a predetermined number of such commands corresponding to a predetermined number of said plurality of selectable activities, whereby upon provision of an execute command, the toy repeats the predetermined number of activities in the order that the commands were given.

15. Apparatus according to claim 9 and wherein in said second mode of operation the controller causes the toy to carry out each activity upon provision by the user of a corresponding sound command and causes the memory to store a predetermined number of such commands corresponding to a predetermined number of said plurality of selectable activities, whereby upon provision of an execute command, the toy repeats the predetermined number of activities in the order that the commands were given.

16. Apparatus according to claim 11 and wherein in said second mode of operation the controller causes the toy to carry out each activity upon provision by the user of a corresponding sound command and causes the memory to store a predetermined number of such commands corresponding to a predetermined number of said plurality of selectable activities, whereby upon provision of an execute command, the toy repeats the predetermined number of activities in the order that the commands were given.

17. Apparatus according to claim 12 and wherein in said second mode of operation the controller causes the toy to carry out each activity upon provision by the user of a corresponding sound command and causes the memory to store a predetermined number of such commands corresponding to a predetermined number of said plurality of selectable activities, whereby upon provision of an execute command, the toy repeats the predetermined number of activities in the order that the commands were given.

18. Apparatus according to claim 1 and wherein said memory is also operative for storing a predetermined sequence of activity commands, and said controller is also operative in response to predetermined inputs for causing the driver assembly to operate the toy in accordance with the predetermined sequence of activity commands.

19. Apparatus according to claim 4 and wherein said memory is also operative for storing a predetermined sequence of activity commands, and said controller is also operative in response to predetermined inputs for causing the driver assembly to operate the toy in accordance with the predetermined sequence of activity commands.

20. Apparatus according to claim 9 and wherein said memory is also operative for storing a predetermined sequence of activity commands, and said controller is also operative in response to predetermined inputs for causing the driver assembly to operate the toy in accordance with the predetermined sequence of activity commands.

* * * * *